US006684466B2

(12) United States Patent
Nishida et al.

(10) Patent No.: US 6,684,466 B2
(45) Date of Patent: Feb. 3, 2004

(54) THREE POINT RELEASE BUCKLE ASSEMBLY

(75) Inventors: Yasutaka Nishida, Macon, GA (US); John J. Valdes, Macon, GA (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 10/015,577

(22) Filed: Dec. 17, 2001

(65) Prior Publication Data

US 2003/0110605 A1 Jun. 19, 2003

(51) Int. Cl.[7] ..... A44B 11/25

(52) U.S. Cl. ..... 24/615; 24/614; 24/625; 24/662

(58) Field of Search ..... 24/573.09, 573.11, 24/578.1, 578.14, 579.09, 579.11, 581.1, 582.1, 582.12, 582.13, 582.14, 612, 614, 615, 618, 662, 620–625, 664–667, 681; 280/801.1, 808

(56) References Cited

U.S. PATENT DOCUMENTS 4,282,634 A * 8/1981 Krauss ..... 24/614
4,679,282 A * 7/1987 Feng ..... 24/614
4,825,515 A * 5/1989 Wolterstorff, Jr. ..... 24/625
4,991,272 A * 2/1991 Bianchi ..... 24/616
5,380,067 A * 1/1995 Turvill et al. ..... 297/484
5,507,076 A * 4/1996 Anscher ..... 24/625
5,551,131 A * 9/1996 Anscher ..... 24/614
5,584,105 A * 12/1996 Krauss ..... 24/614
5,584,106 A * 12/1996 Anscher ..... 24/625
5,590,444 A * 1/1997 Krauss ..... 24/625
5,659,931 A * 8/1997 Anscher ..... 24/614
5,774,956 A * 7/1998 French et al. ..... 24/625
5,926,928 A * 7/1999 Lundstedt ..... 24/625
6,052,875 A * 4/2000 Fudaki ..... 24/625
6,138,330 A * 10/2000 Galbreath ..... 24/625
6,311,374 B1 * 11/2001 Anscher ..... 24/625
6,421,889 B1 * 7/2002 Chien ..... 24/614
2001/0032379 A1 * 10/2001 Chang
2002/0014096 A1 * 2/2002 Kaneko et al.
2002/0017011 A1 * 2/2002 Kawamura

* cited by examiner

*Primary Examiner*—Robert J. Sandy
*Assistant Examiner*—Ruth C. Rodriguez
(74) *Attorney, Agent, or Firm*—Kramer & Amado, P.C.

(57) ABSTRACT

A safety buckle assembly including a male member and a female member that interlockingly and releasably engages the male member. The buckle male member is disengaged from the female member by squeezing the side latches towards each other, to disengage the same from the side catches, while simultaneously pressing the push release button such that the central latch is disengaged from the central catch formed in the female member.

17 Claims, 10 Drawing Sheets

THREE POINT RELEASE BUCKLE ASSEMBLY

BACKGROUND

The present invention relates to buckles, and in particular to a snap buckle for releasably connecting straps, belts or the like, that includes various safety features that prevent inadvertent and unwanted release.

Safety straps are traditionally secured to grocery store carts or other similar vehicles to provide a seatbelt-type restraint in an effort to assure the safety of an occupant or item that is being transported in the shopping cart. Such devices are securely attached to the shopping cart in a manner such that the safety buckle does not become accidentally detached from the cart. Additionally, buckles are used to secure loads carried by various item containers such as backpacks, luggage, fanny packs, etc. The aforementioned devices typically utilize a conventional side release buckle wherein a male member having one or two side latching arms is coupled to a female member that has complimentary catches that enable the male and female members to interlockingly engage one another to secure the system.

Due to the type of systems that these side release buckles are utilized in, the buckles may be subject to various pressures on one or both sides thereof. In these conventional systems, pushing inwardly on one or both of the side latching arms such that the catches release the latches effects disengagement of the securement device. Due to the resiliency of the side latching arms, the disengagement of the side latching arms from the catch cause the side latching arms to spring back to their original position. This resilient force forces the male member to accelerate in an outwardly direction resulting in the male member sliding out of the guide channel of the female member. Furthermore, young children may try to disengage the buckle resulting in a risk to injury to the child.

Thus, a buckle with a safety feature, that is both difficult for a young child to disengage and resistant to unwanted and inadvertent disengagement due to external forces exerted on the buckle, is needed.

SUMMARY

The present invention provides a safety buckle assembly that incorporates structural features that enable a strong and reliable coupling between the male and female members of the clip assembly. Due to these structural features, unwanted and inadvertent disengagement of the male member from the female member that may result in harm or damage to the occupants and/or items secured by the buckle is minimized.

According to the present invention, there is provided a safety buckle assembly comprising a male member that interlockingly and releasably engages a female member. The male member includes a base wall that has a pair of side locking arms each having a latch, a central locking arm having a latch, and a plurality of forming ribs extending therefrom. The central locking arm is longer in length than the side locking arms to afford the central locking arm greater resiliency and flexibility. The female member includes a receiving cavity, that receives the male member when the buckle is fastened, a push button release that engages the central locking arm, two opposing side catches that engage the side locking arm latches, a central catch that engages the central latch, and an opening that enables a user to disengage the buckle assembly in an alternative fashion.

Two parallel guiding walls are formed in the cavity and used to guide the central locking arm when the male member engages the female member. The correct orientation of the buckle assembly is assured due to the engagement of the forming ribs with projections that extend from the cavity of the female member when the buckle assembly is fastened.

Many other advantages and features of the present invention will become manifest to those versed in the art upon making reference to the detailed description and the accompanying drawings in which a preferred structural embodiment incorporating the principles of the present invention is shown by way of example.

DETAILED DESCRIPTION

Figure 1:
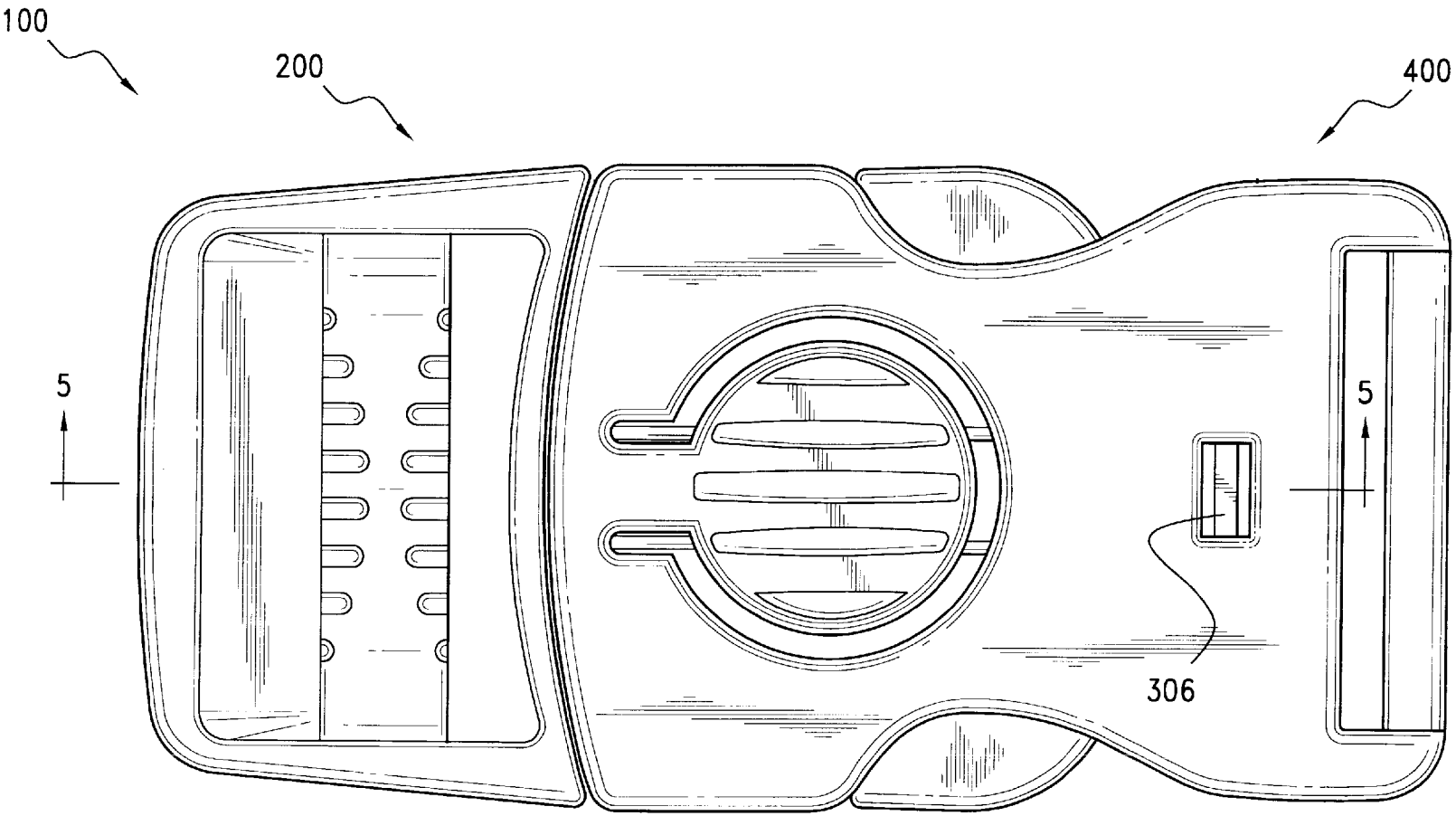
FIG. 1 is a plan view of a safety buckle assembly according to the present invention.

FIG. 1 shows a buckle assembly 100 according to one embodiment of the present invention. The buckle assembly 100 is composed of a male member 200 that is interlockingly and releasably coupled with a female member 400. The buckle assembly 100 including the male and female members 200,400 may be molded from a variety of extrudable materials. These may include LDPE, HDPE, ABS, polystyrene, polypropylene, acetates, butyrates, nylons, polyphenylene sulfides, acetals, polycarbonates, thermoplastic rubbers, and polyesters, among others.

Figure 2:
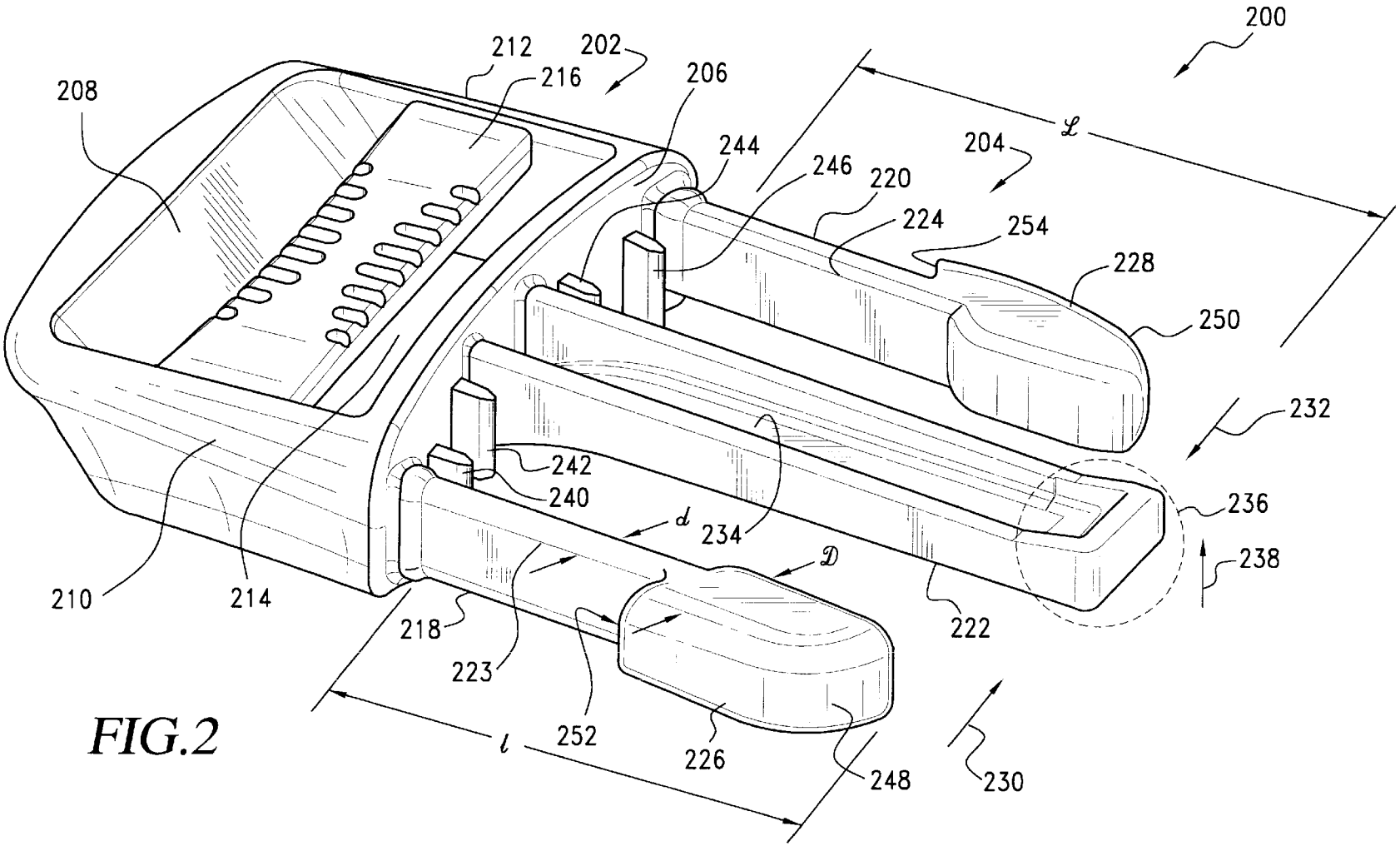
FIG. 2 is a perspective view of a male member of the safety buckle assembly of FIG. 1.

As shown in FIG. 2, the male member 200 generally includes a handle 202, and an engagement portion 204, wherein handle 202 is separated from engagement portion 204 by a base wall 206. The handle 202 has a generally rectangular shape and is formed by a sloping back wall 208 that is spaced from and parallel to base wall 206, and two opposing side walls 210,212 that connect base wall 206 to back wall 208 to define an opening 214 therebetween. Connected to side walls 210,212 is a bar 216 that traverses opening 214 and configured to retain a strap, belt, or some other form of elongated member such as a member 490 shown in FIG. 4.

The engagement portion 204 generally includes base wall 206 and a plurality of projections that extend therefrom including two side locking arms 218,220, a central locking arm 222, and a plurality of forming ribs 240, 242, 244, and 246. Each of the side locking arms 218,220 includes an extension member 223, 224 and a latch element 226, 228, respectively, that is disposed on the distal end of each extension member 223, 224. The side locking arms 218 and 220 are configured to be resilient in relation to base wall 206. In this manner, side locking arms 218 and 220 bend horizontally in the directions of arrows 230 and 232, respectively, when a sufficient amount of force is exerted upon them. As seen from FIG. 2, a diameter D of latch elements 226 and 228 is sufficiently larger than a diameter d of extension members 223 and 224 such that a user may be able to manipulate side locking arms 218 and 220 with ease when engaging or disengaging the buckle assembly. Additionally, latch elements 226 and 228 each include a sloping surface 248 and 250, respectively, that is configured to engage female member 400 during the engagement process of buckle assembly 100. Latch elements 226 and 228 also include engagement surfaces 252 and 254, respectively, that are configured to engage complimentary catches formed in female member 400, discussed below.

The central locking arm 222 includes a groove 234 located therein that runs substantially the entire length of locking arm 222. A central latch element 236, encircled by the dotted line shown in FIG. 2, is disposed on the distal most end of central locking arm 222. The central locking arm 222 is configured to be resilient in relation to base wall 206 in that central locking arm 222 bends in a vertical direction indicated by arrow 238 when a sufficient amount of force in the direction of arrow 238 is exerted upon it. As shown in FIG. 2, central locking arm 222 has a length L that is longer than a length l of the side locking arms 218 and 220. The length L affords central locking arm 222 a high degree of flexibility and a large contact surface when the buckle system is engaged. The combination of the large contact area and the high degree of flexibility effects a more reliable and secure engagement between male member 200 and female member 400. The central latch 236 will be described in more detail with reference to FIG. 3, discussed below.

Forming ribs 240, 242, 244, and 246 each extend from base wall 206 and are configured to be relatively stiff. Forming ribs 240 and 242 are disposed between and spaced equidistantly from side locking arm 218 and central locking arm 234. Similarly, forming ribs 244 and 246 are disposed between and spaced equidistantly from side locking arm 220 and central locking arm 234.

Figure 3:
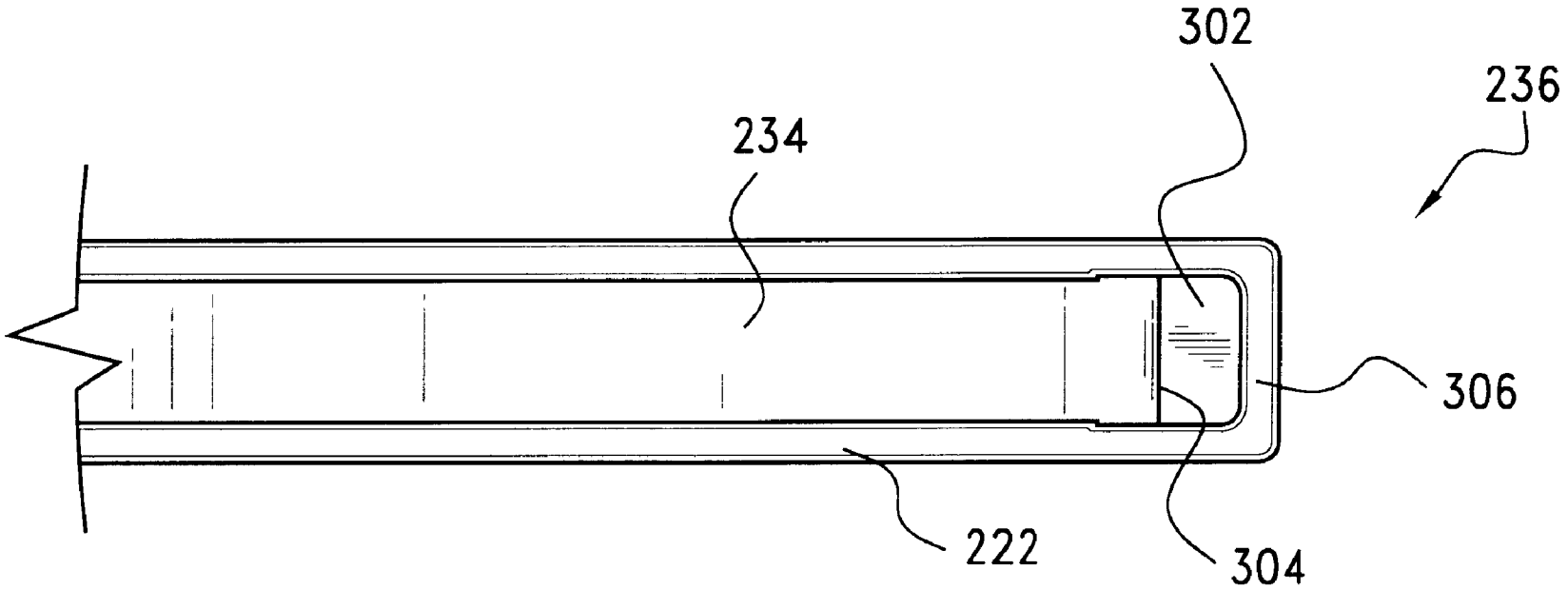
FIG. 3 is an enlarged view of a central latch member shown in FIG. 2.

Referring to FIG. 3, a more detailed description of central latch 236 will be given. Central latch 236 of the central locking arm 222 includes a recess 302, a sloping surface 304, and a wall 306. As shown in FIGS. 2 and 3, recess 302 is disposed at the most distal end of groove 234, and has a substantially planar surface. Recess 302 is separated from groove 234 by a downwardly sloping surface 304. Therefore, recess 302, bordered by sloping surface 304 and wall 306, forms central latch 236 that is configured to retain a catch formed on the female member 400, discussed below.

Female member 400 will be discussed with reference to FIGS. 4 and 5. Female member 400 generally consists of a body 402 and a strap retaining portion 404. Body 402 includes a first open end 406, a second closed end 408 bordered by back wall 410 shown in dotted lines, retaining projections 412, 414, and 416, push release button 418, side catches 420 and 422, opening 424, guiding walls 426 and 428, and a central catch 430 shown in dotted lines.

Open end 406 is defined by a lower surface 432, an upper surface 434, and two side surfaces 436 and 438 that join lower surface 432 and upper surface 434. A cavity 440 is defined between open end 406 and back wall 410 of the body. Projections 412, 414, and 416 are formed in most proximal edge of lower surface 432 are configured to fittingly engage forming ribs 240, 242, 244, and 246 when the buckle assembly is engaged. Guiding walls 426 and 428 are disposed on lower surface 432 of body 402 and are substantially the same length as cavity 440. Guiding walls 426 and 428 are configured to engage central locking arm 222 when male member 200 is inserted into female member 400. In a preferred embodiment, guiding walls 426 and 428 are connected to back wall 410 for a more stable buckle system.

Side surfaces 436 and 438 have sloping surfaces 446 and 448, respectively, formed therein that are configured to engage side locking arms 218 and 220 when male member 200 is inserted into female member 400. Side catch 420 is defined by an opening 442 formed in the sloped surface 446 of side surface 436. Similarly, side catch 422 is defined by an opening 444 formed in sloped surface 448 of side surface 436. Side catches 422 and 420 are configured to interlockingly engage latch elements 226 and 228, respectively, when the buckle assembly is engaged.

Central catch 430 is formed on and extends from upper surface 434 a distance into the cavity 440 of body 402. Central catch 430 is configured to engage central latch 236 of central locking member 222 when the buckle assembly is engaged. Push release button 418 is formed on upper surface 434 of body 402 and includes an upper free end 450 and a lower fixed end 452 wherein upper end 450 is translatable, in a downward direction in relation to a fixed lower end 452, when a downward force is exerted thereon. Push button 418 is configured to resiliently engage central locking member 222 in an effort to disengage male member 200 from female member 400. In a preferred embodiment of the present invention, push release button 418 is formed in a circular configuration to more comfortably accommodate a user's finger upon actuation of button 418. However, push button 418 may embody any other convenient shape that is suitable for its purpose.

Figure 4:
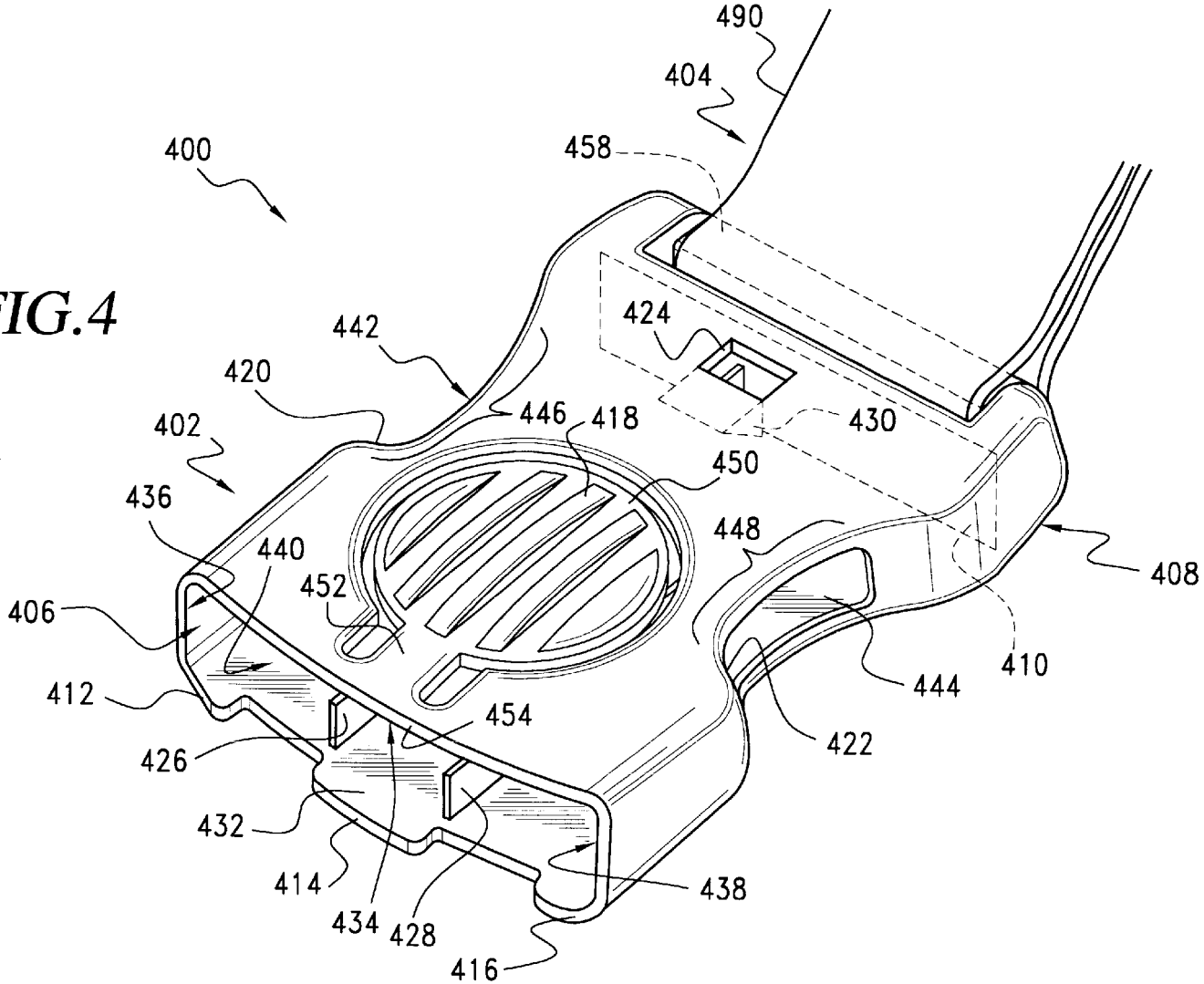
FIG. 4 is a perspective view of a female member of the safety buckle assembly of FIG. 1.

Strap retaining portion 404 of female member 400 includes a strap retaining bar 458, shown in dotted lines, that is configured to retain a strap, belt, or some other form of elongated member such as the member 490 shown in FIG. 4. Opening 424 is a substantially rectangular opening formed in upper surface 434 of body 402 and configured such that wall 306 of central latch 236 is visible to a user looking at upper surface 434 of engaged buckle assembly 100 in a downwardly direction, such as seen in FIG. 1. One example of the operation of the opening 424 will be discussed below with reference to disengaging the buckle assembly 100 of the present invention.

Figure 5:
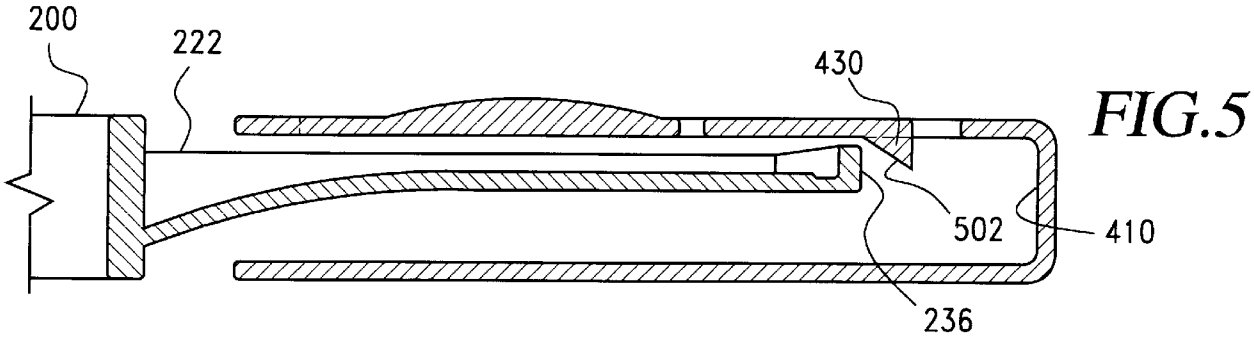
FIG. 5 is a sectional view of the safety buckle assembly shown in FIG. 1 taken in the direction indicated by line 5—5 of FIG. 1 to show the buckle with the male member less than fully inserted into the female member.
Figure 6:
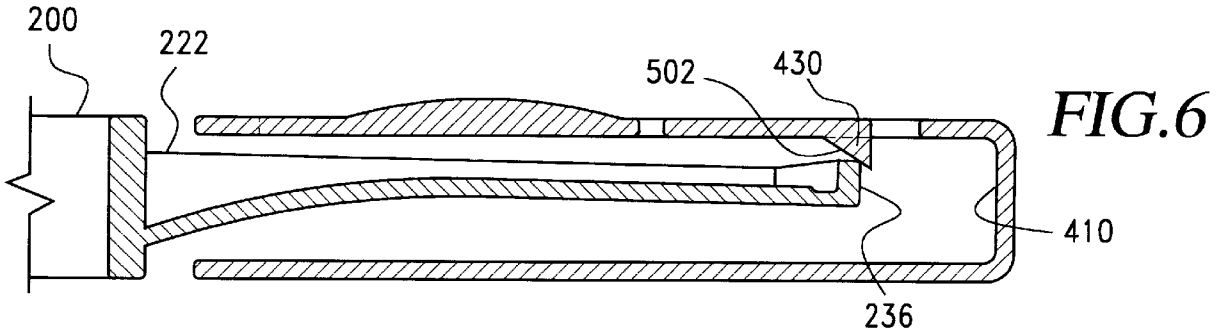
FIG. 6 is a view similar to FIG. 5, but showing the buckle with the central locking arm partially engaging a central catch.

With reference to FIGS. 2–7, the engagement of buckle assembly 100 will be described in detail. During the operation of fastening the buckle assembly, engagement portion 204 of male member 200 is aligned with cavity 440 of female member 400 such that the distal end of central locking arm 222 is inserted between guiding walls 426 and 428 and latch elements 226 and 228 of side locking arms abut side surfaces 438 and 436, respectively. At this point, an engagement force is exerted upon the male and female members 200 and 400 such that side locking arms 218 and 220 are moved in the direction of arrows 230 and 232, respectively, as a result of the enlarged diameter D and sloped surfaces 248 and 250 of latch elements 226 and 228, respectively, engaging side surfaces 438 and 436. At this point, a greater portion of the length L of central locking arm 222 is positioned in cavity 440, between guiding walls 426 and 428, with central latch 236 positioned just proximate of central catch 430, as shown in FIG. 5. At this point, engagement portion 204 of male member 200 has resiliently conformed to the shape of first open end 406 and cavity 440 of female member 400 such that latch elements 226, 228, and 236 may slide into alignment with complimentary side catches 422, 420 and central catch 430, respectively. As male member 200 is further inserted within female member 400, wall 306 of central locking arm 222 engages a sloping surface 502 of central catch 430 and is forced in a downward direction, as shown in FIG. 6. At this point, a distal portion of sloping surfaces 248 and 250 are adjacent to openings 444 and 442, respectively. Additionally, projections 416 and 414 are in alignment with forming ribs 240 and 242. Similarly, projections 414 and 412 are in alignment with forming ribs 244 and 246.

Figure 7:
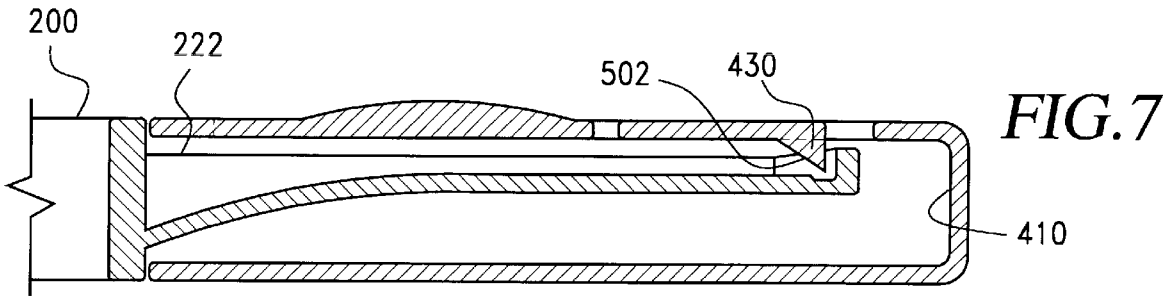
FIG. 7 is a view similar to FIG. 5, but showing the buckle with the central locking arm fully engaging the central catch.

Continuation of the engagement force upon male and female members 200 and 400 results in wall 306 of central latch 236 being pushed over the distal most part of slope surface 502 resulting in central locking arm 222 resiliently moving in an upward direction, back to its original state, as seen in FIG. 7. Thus, central catch 430 is retained between wall 306 and sloping surface 304. Additionally, latch elements 226 and 228 are positioned adjacent to openings 444 and 442, respectively, in a manner such that engaging walls 252 and 254 are adjacent to openings 444 and 442, respectively. Therefore, the forces exerted on sloping surfaces 248 and 250 by side surfaces 438 and 436, respectively, cease to exist allowing latch elements 226 and 228 to fill openings 444 and 442. Due to the resiliency of side locking arms 218 and 220, side locking arms 218 and 220 resume their original position in relation to central locking arm 222. In this manner, engagement surfaces 252 and 254 engage side catches 422 and 420. Furthermore, projections 416 and 414 engage forming ribs 240 and 242, respectively, and projections 414 and 412 engage forming ribs 244 and 246.

In this manner, a secure buckle arrangement is effected due to the mating of side catches 422 and 420 and central catch 430 of female member 400 with latches 226, 228, and 236, respectively, of male member 200. Additionally, a proper engagement of male member 200 with female member 400 is assured due to the forming ribs engagement to projections 412, 414, and 416. For example, if male member 200 is inserted into female member 400 in a reverse manner such that sloping surface 248 engages side surface 436 and sloping surface 250 engages side surface 438, forming ribs 240, 242, 244, and 246 would engage the most proximal surface 454 of upper surface 434. This engagement would prevent latch elements 226, 228 and 236 from engaging catches 422, 420, and 430, respectively, thus prohibiting the securement of male member 200 to female member 400.

Figure 8:
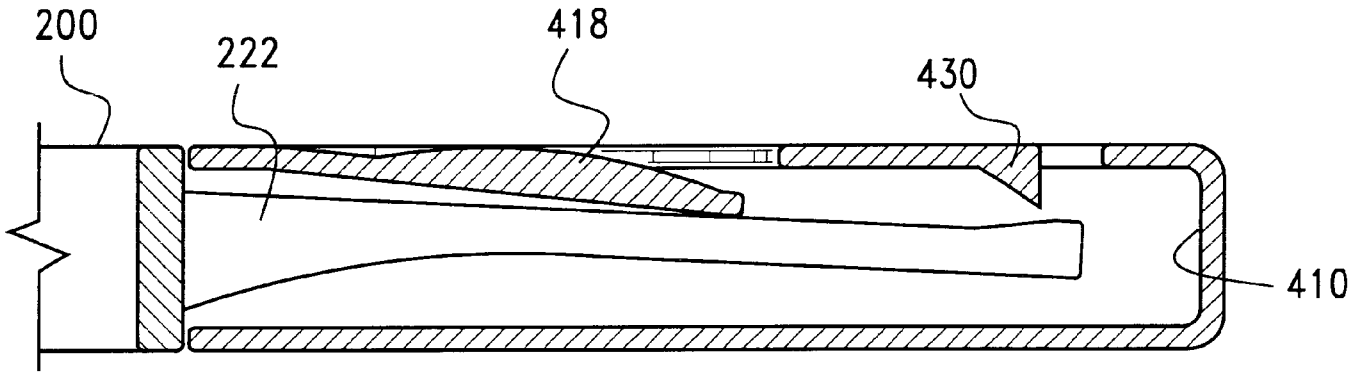
FIG. 8 is a view similar to FIG. 5, but showing a push release button engaging the central locking arm.

The disengagement of buckle assembly 100 will now be described in detail with reference to FIGS. 1–4, 8 and 9. To disengage male member 200 from female member 400, a force must be exerted upon latches 226 and 228 to push them towards one another in the direction of arrows 230 and 232. The movement of latches 226 and 228 in this direction releases engagement surfaces 252 and 254 from side catches 422 and 420, respectively. This operation is well known in the art and thus will not be described in any further detail. In addition to the force exerted upon latch elements 226 and 228, a simultaneous downward force must be exerted upon push release button 418 to disengage central latch 236 from central catch 430. Once a sufficient force has been exerted upon push button 418, central locking arm 222 will be forced in a downward direction through the actuation of push button 418 upon central locking arm 222, as seen in FIG. 8. Once latches 226 and 228, and central latch 236 have been disengaged from side catches 422 and 420, and central catch 430, respectively, a disengagement force may be exerted upon male member 200 and female member 400 that effectively pulls male member 200 and female member 400 in opposite directions to effect disengagement of the buckle assembly 100. Due to the requirement of disengaging three latches from their respective catches before the buckle assembly may be disengaged, the accidental disengagement of the buckle assembly due to external forces on one or two latches included in the buckle assembly is averted. Due to the design of the buckle assembly 100, a user may use one hand to facilitate the disengagement of the male member 200 from the female member 400.

As seen in FIGS. 1 and 4, push release button 418 is formed substantially in the center of upper surface 434 and central catch 430 is disposed close to back wall 410, intermediate push release button 418 and back wall 410. Due to the length L of central locking arm 222 and the placement of central catch 430 within cavity 440 of female member 400, push release button 418 engages central locking arm 222 at a point substantially in the center of central locking arm 222, as seen in FIG. 8, during the disengagement of buckle assembly 100. Those having skill in the art can appreciate that the combination, of the placement of push release button 418, central catch 430, and central latch 236, and the manner in which push release button 418 engages central locking arm 222, allows for a very stable disengagement of buckle assembly 100.

Figure 9:
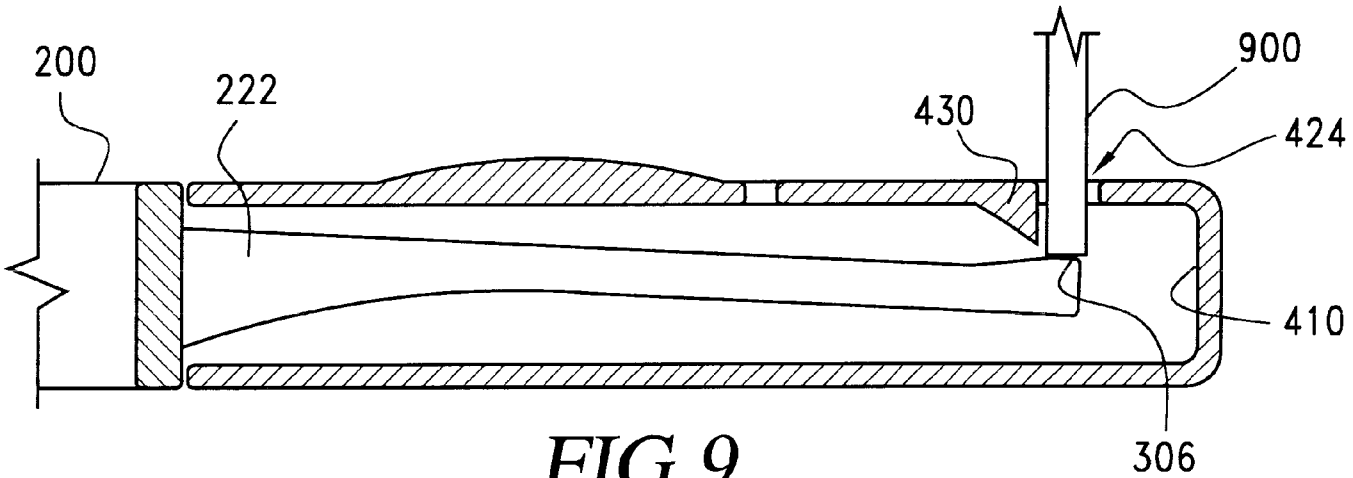
FIG. 9 is a view similar to FIG. 5, but showing the central locking arm being disengaged from the central catch by an external actuator.

In a second embodiment of the present invention, a second method of disengagement of male member 200 from female member 400 may be affected. In this embodiment, opening 424 may also be used to disengage central latch 236 of central locking arm 222 from central catch 430. The opening has the further benefit of being configured to enable the addition of structural features to the female member during and after manufacturing. These features may include the internal central catch 430, or other features that may be desired. The emergency disengagement method of the present invention will now be described in detail. Opening 424 is configured such that it physically borders central catch. Additionally, the dimensions of opening 424 are such that wall 306 of central locking arm 222 may be clearly seen and manipulated to effect the release of central latch 236 from central catch 430. To effect this end result, an external actuator 900 that has a distal configuration comparable to the dimensions of opening 424 may be used to exert a downward force on wall 306 of central locking arm 222 such that central catch 236 disengages central latch 430, as seen in FIG. 9. At this point, the disengagement of male member 200 from female member 400 is accomplished by the simultaneous disengagement of side catches 422 and 420 from latch elements 226 and 228 in the same manner as described above. In this manner, if push release button 418 were to ever become inoperable, the buckle assembly of the present invention may be disengaged by utilizing a second method that is fast, safe, and reliable while ensuring that the operation of buckle assembly 100 is not compromised any further. To this end, emergency release opening 424 gives a user an alternative method to release buckle assembly 100 without damaging the assembly any further.

Figure 10:
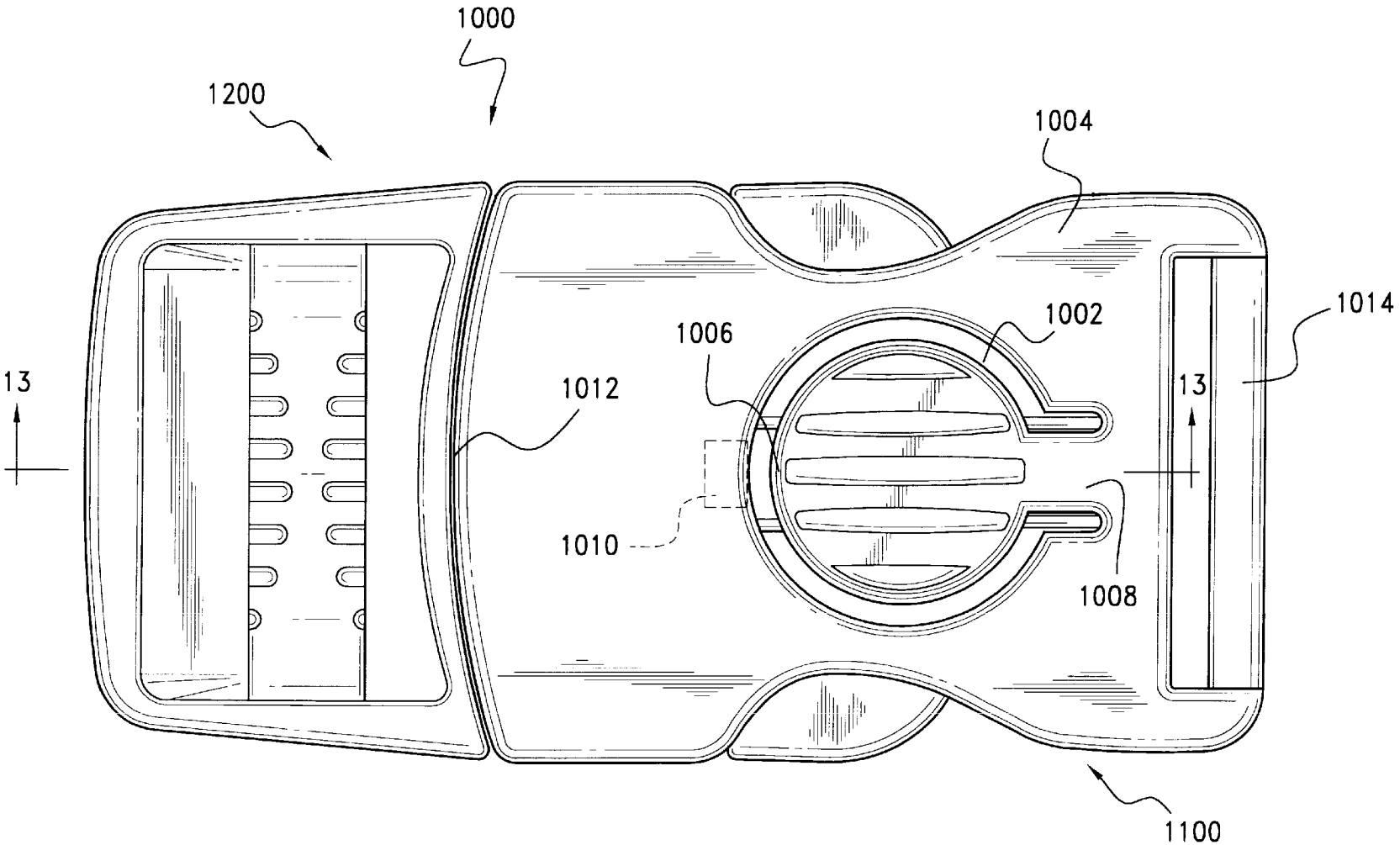
FIG. 10 is a top view of the safety buckle assembly according to another embodiment of the present invention.

FIG. 10 illustrates an alternative embodiment of the present invention. Referring to FIG. 10, a buckle assembly 1000 is shown wherein a male member 1200 is interlockingly engaged to a female member 1100. In this embodiment, a push release button 1002 is formed in a top surface 1004 and has a free end 1006 that faces male member 1200 and a fixed end 1008 that faces a strap retaining bar 1014. A central catch 1010, shown in dotted lines, is formed intermediate push release button 1002 and proximal end 1012 of female member 1100.

Figure 11:
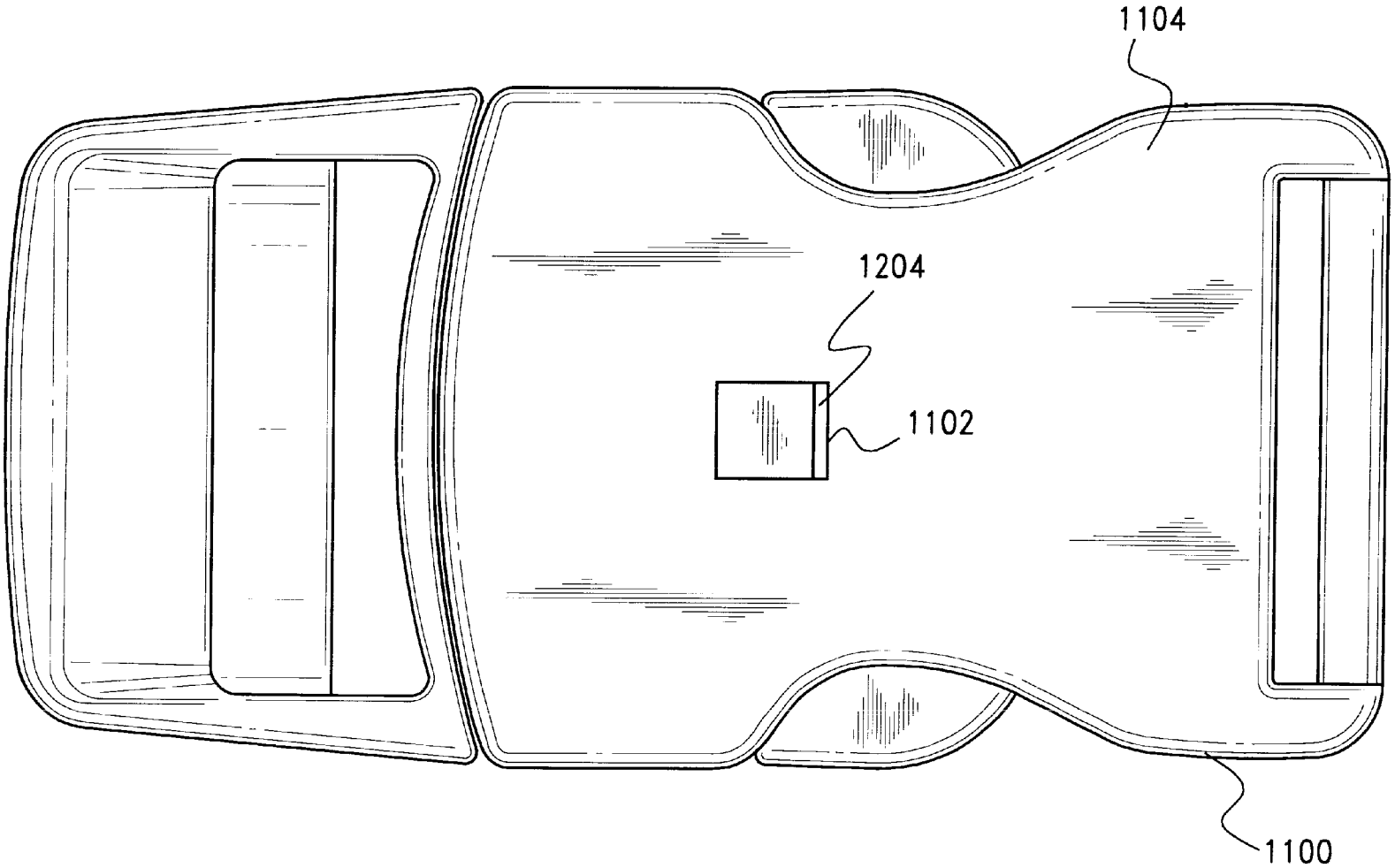
FIG. 11 is a bottom view of the safety buckle assembly of FIG. 10.

FIG. 11 illustrates a bottom view of buckle assembly 1000 shown in FIG. 10. In this embodiment, opening 1102 is formed in a bottom surface 1104 of female member 1100. Opening 1102 may be utilized to effect a permanent securement of male member 1200 to female member 1100 (discussed below), though the opening 1102 enables central catch 430 to be configured inside the female member easily and inexpensively. Other parts of female member 1100 are the same as the embodiment shown in FIG. 4.

Figure 12:
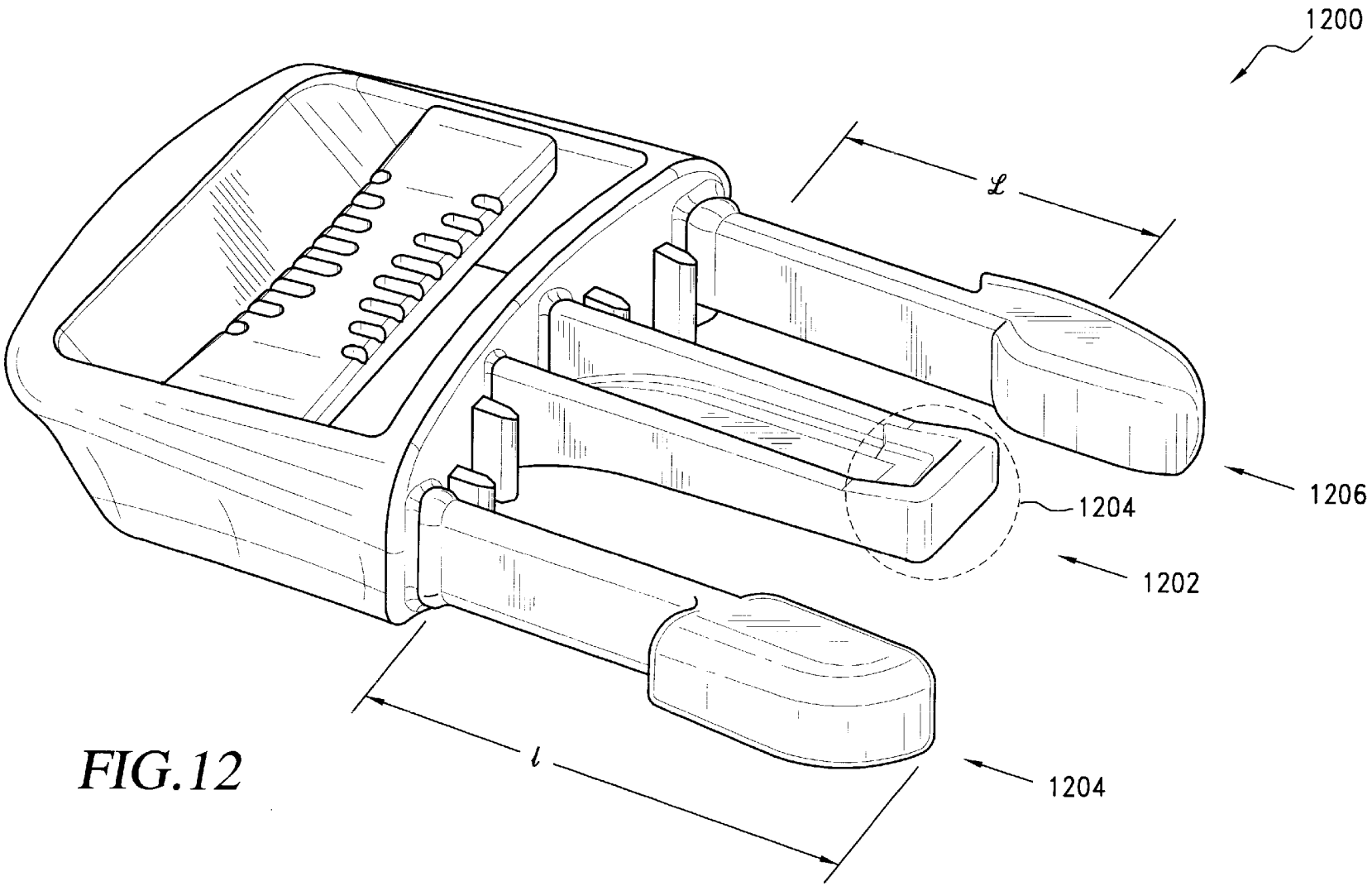
FIG. 12 is a perspective view of a male member of the safety buckle assembly of FIG. 9.

FIG. 12 illustrates male member 1200 of buckle assembly 1000. In this embodiment, a central locking arm 1202 has a length L that is shorter than a length l of side locking arms 1204 and 1206. A central latch 1204 is formed on central locking arm 1202 and has substantially the same configuration as central latch 236 shown in FIGS. 2 and 3 of the present invention. Other parts, as well as other operating steps, are the same as male member 200 shown in FIG. 2 of the present invention.

Figure 13:
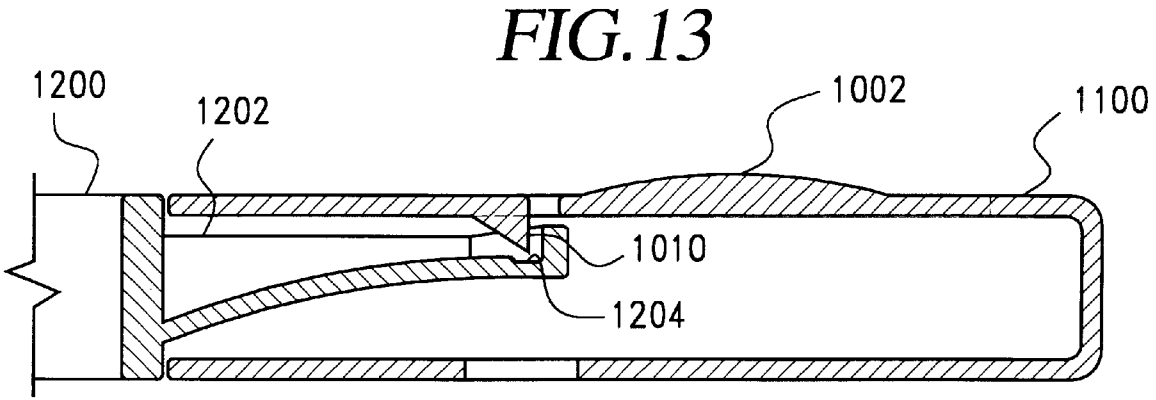
FIG. 13 is a sectional view of the safety buckle assembly shown in FIG. 10 taken in the direction indicated by line 13—13 of FIG. 10 to show the buckle with the male member fully inserted into the female member.

The engagement of central locking arm 1202 with central catch 1010 is shown in FIG. 13. As seen in detail in FIG. 13, when male member 1200 is interlockingly engaged with female member 1100, central latch 1204 of central locking arm 1202 engages central catch 1010 to effect the securement of male member 1200 to female member 1100. As seen in FIGS. 10–13, one having ordinary skill in the art can appreciate that the securement and disengagement of buckle assembly 1000 is effected in substantially the same manner as the securement and disengagement of buckle assembly 100, described above.

Figure 14:
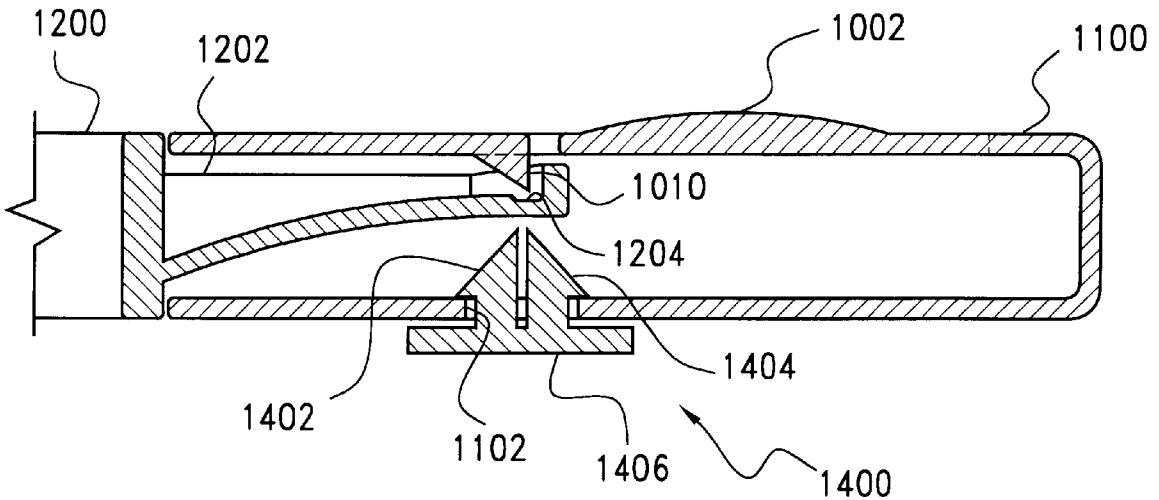
FIG. 14 is a view similar to FIG. 13, but showing the buckle assembly of FIG. 10 with a permanent locking mechanism engaging the buckle assembly.

With reference to FIG. 14, a method and apparatus for effecting a securement of buckle assembly 1000 is shown. As illustrated in FIG. 14, opening 1102 may be utilized to prevent the disengagement of central catch 1010 from central latch 1204. In this effort, a securement mechanism 1400, comprising resilient legs 1402,1404 and base 1406, is configured to engage female member 1100 via opening 1102. One having ordinary skill in the art can appreciate that legs 1402 and 1404 prevent central locking arm 1202 from moving in a downwardly direction and thus preventing central latch 1204 from disengaging central catch 1010 when push release button 1002 is manipulated. Therefore, male member 1200 is prevented from disengaging female member 1100 when securement mechanism 1400 is in place.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

We claim:

1. A safety buckle assembly comprising:

a male member including:

a base wall;

a pair of side locking arms extending from the base wall;

a central locking arm extending from the base wall and disposed between the side locking arms;

at least one forming rib extending from the base wall; and a female member configured to interlockingly engage the male member, wherein the at least one forming rib ensures a correct orientation of the male member when the male member interlockingly engages the female member and wherein the female member includes a first open end, a second closed end, and at least one projection disposed on the first open end wherein the at least one projection is configured to engage the at least one forming rib when the male member interlockingly engages the female member;

wherein the female member further includes a resilient push release button, and a cavity disposed between the first open end and the second closed end and defined by a top wall having top and bottom surfaces, a bottom wall substantially parallel to and spaced from the top wall, and a pair of opposing side walls connecting the top and bottom walls, wherein the push release button is formed in the top wall of the cavity;

wherein a catch is disposed on the bottom surface of the top wall of the female member and configured to engage the central locking arm when the buckle is fastened; and wherein the push release button is disposed between the catch and the open end and is configured to force the central locking arm in a downward direction to thereby disengage the central locking arm from catch when the push release button is forced in a downward direction.

2. A safety buckle assembly comprising:

a) a male member including:

(1) a base wall;

(2) a pair of side locking arms extending from the base wall;

(3) a central locking arm extending from the base wall and disposed between the side locking arms, the central locking arm including a latch formed thereon; and b) a female member configured to interlockingly engage the male member, the female member including:

(1) a catch configured to interlockingly engage the latch and a push release button formed therein and disposed intermediate the catch and the base wall; and (2) an opening, whereby a user may gain access to the latch via the opening to disengage the latch from the catch.

3. The safety buckle assembly of claim 2 wherein the opening is configured to enable addition of structural features to the female member.

4. The safety buckle assembly of claim 3 wherein the structural feature comprises the catch.

5. The safety buckle assembly of claim 2 wherein the female member further includes a top wall having top and bottom surfaces, a bottom wall substantially parallel to and spaced from the top wall, and a pair of opposing side walls connecting the top and bottom walls, a first open end defined by an opening between the top, bottom, and pair of side walls, a second closed end substantially parallel to and spaced from the open end and defined by a back wall connecting the top, bottom, and a pair of side walls, a catch disposed on the top wall and configured to interlockingly engage the central locking arm when the buckle is fastened, wherein the opening is defined in the top wall.

6. The safety buckle assembly of claim 5 wherein the male member further includes at least one forming rib, and wherein the female member further includes a projection that extends from the first opening, the at least one forming rib configured to engage the projection when the buckle assembly is fastened.

7. The safety buckle assembly of claim 5 wherein the female member further includes a resilient push button release assembly formed in the top wall between the first open end and the opening.

8. The safety buckle assembly of claim 5 wherein the female member further includes two parallel guiding walls attached to the bottom wall that extend substantially the length of a cavity defined between the first open and the first closed end, the guiding walls engaging the central locking arm when the buckle is fastened.

9. The safety buckle assembly of claim 5 wherein each of the side locking arms further includes a distal end and a latch disposed on the distal end, and wherein the side walls each include an opening formed therein, the opening configured to receive the latch when the buckle is fastened.

10. A safety buckle assembly comprising:

a) a male member including:
(1) a base wall;
(2) a pair of side locking arms extending from the base wall;
(3) a central locking arm extending from the base wall, disposed between the side locking arms, and having a length that is longer than the side locking arms, the central locking arm having a latch formed thereon; and b) a female member including:
(1) a top wall;
(2) a bottom wall;
(3) a pair of interconnecting side walls;
(4) a back wall;
(5) a first open receiving end disposed opposite the back wall, defined by the top, bottom, and pair of side walls, and configured to receive the male member;
(6) a push release button formed in the top wall of the female member; and
(7) a catch, disposed intermediate the push release button and the back wall, that is configured to engage the latch.

11. The safety buckle assembly of claim 10 wherein the female member further includes at least one projection disposed on the first open end, and wherein the male member further includes at least one forming rib extending from the base wall, the at least one projection configured to engage the at least one forming rib when the buckle assembly is fastened.

12. The safety buckle assembly of claim 10 further including an opening formed in the top wall and disposed adjacent the catch.

13. The safety buckle assembly of claim 12 wherein the opening is configured to enable addition of structural feature to the female member.

14. The safety buckle assembly of claim 13 wherein the structural feature comprises the catch.

15. The safety buckle assembly of claim 10 wherein the female member further includes two parallel guiding walls attached to the bottom wall that extend substantially a length of a cavity defined between the first open end and the back wall, the guiding walls engaging the central locking arm when the buckle is fastened.

16. A safety buckle assembly comprising:

a) a male member including:
(1) a base wall,
(2) a pair of side locking arms extending from the base wall,
(3) a central locking arm extending from the base wall, disposed between the side locking arms, and having a length that is longer than the side locking arms, the central locking arm having a latch formed thereon, and
(4) at least one forming rib extending from the base wall, and b) a female member including:
(1) a top wall having top and bottom surfaces, a bottom wall substantially parallel to and spaced from the top wall, and a pair of opposing side walls connecting the top and bottom walls;
(2) a first open end defined between the top, bottom, and pair of side walls;
(3) a second closed end substantially parallel to and spaced from the open end and defined by a back wall connecting the top, bottom, and pair of side walls;
(4) a push release button disposed in the top wall;
(5) a cavity defined between the first open end and the back wall;
(6) a catch disposed on the top wall between the push release button and the back wall, and configured to interlockingly engage the central locking arm when the buckle is fastened;
(7) an opening defined in the top wall whereby a user may gain access to the interior of the female member and disengage the central locking arm from the catch;
(8) two parallel guiding walls attached to the bottom wall that extend substantially the entire length of the cavity and are configured to engage the central locking arm; and
(9) at least one projection configured to engage the at least one forming rib when the buckle is fastened.

17. A safety buckle assembly comprising:

a) a male member including:
(1) a base wall;
(2) a pair of side locking arms extending from the base wall and having a length 1;
(3) a central locking arm extending from the base wall having a length L>1 and a central catch formed in a distal end thereof; and b) a female member configured to interlockingly engage the male member, including:
(1) a top wall having a first end and a second end;
(2) a bottom wall;
(3) a pair of interconnecting side walls;
(4) a back wall formed connecting the second end of the top wall to the bottom and interconnecting side walls;
(5) a resilient push release button formed within and substantially equidistant from the first and second ends and adapted to move in a downwardly direction; and
(6) a central catch disposed on the top wall between the push release button and the back wall, wherein the push release button is configured to engage the central locking arm at a point that is located substantially in the center of the length L when moved in the downwardly direction.

* * * * *